US007210442B2

(12) United States Patent
Toyoshima

(10) Patent No.: US 7,210,442 B2
(45) Date of Patent: May 1, 2007

(54) ENGINE CONTROL METHOD AND SYSTEM HAVING A VOLTAGE INCREASING CIRCUIT

(75) Inventor: Yoshio Toyoshima, Chiryu (JP)

(73) Assignee: DENSO Corporation, Kariya (JP)

( * ) Notice: Subject to any disclaimer, the term of this patent is extended or adjusted under 35 U.S.C. 154(b) by 0 days.

(21) Appl. No.: 11/255,876

(22) Filed: Oct. 24, 2005

(65) Prior Publication Data

US 2006/0086333 A1 Apr. 27, 2006

(30) Foreign Application Priority Data

Oct. 22, 2004 (JP) ..... 2004-308294

(51) Int. Cl.
*F02D 45/00* (2006.01)
*F02N 11/08* (2006.01)

(52) U.S. Cl. ..... 123/179.3; 701/113

(58) Field of Classification Search ..... 123/179.3; 701/113; 306/10.6
See application file for complete search history.

(56) References Cited

U.S. PATENT DOCUMENTS 6,202,615 B1 * 3/2001 Pels et al. ..... 123/179.3
6,481,406 B2 * 11/2002 Pels ..... 123/179.3
7,107,956 B2 * 9/2006 McGee et al. ..... 123/179.3

FOREIGN PATENT DOCUMENTS

| | | |
|---|---|---|
| JP | 2002-250265 | 9/2002 |
| JP | 2003-056386 | 2/2003 |
| JP | 2003-148221 | 5/2003 |

* cited by examiner

*Primary Examiner*—Stephen K. Cronin
*Assistant Examiner*—Arnold Castro
(74) *Attorney, Agent, or Firm*—Nixon & Vanderhye P.C.

(57) ABSTRACT

An engine control system includes an ignition switch, a starter switch which operates a starter of an engine after the ignition switch has been turned on, and a voltage increasing circuit which increases a battery voltage to a higher voltage. The engine control system controls the voltage increasing circuit to start to increase a voltage from a battery to the higher voltage upon a timing of turning on the starter switch. Thus, radio noises caused by an operation of the voltage increasing circuit may be avoided from time at which the ignition switch is turned on to time at which the starter switch is turned on (during a quiet time period).

11 Claims, 4 Drawing Sheets

ENGINE CONTROL METHOD AND SYSTEM HAVING A VOLTAGE INCREASING CIRCUIT

CROSS REFERENCE TO RELATED APPLICATION

This application is based on and incorporates herein by reference Japanese Patent Application No. 2004-308294 filed on Oct. 22, 2004.

TECHNOLOGICAL FIELD

Exemplary embodiments of the present technology described herein relate to an engine control system with a voltage increasing circuit (e.g., DC—DC converter) supplying a higher voltage to an operational device (e.g., injector, spark plug) which is necessary for running an engine (internal combustion engine).

DESCRIPTION OF RELATED ART

Recently, proposed fuel injectors improve response by supplying a higher voltage to an electromagnetic valve of the injector. This kind of fuel injector is for example disclosed in JP-A-2003-056386.

In addition, another proposed fuel injector includes a piezoactuator having many stacked piezoelectric elements for use as an actuator of the fuel injector. The piezoactuator receives higher voltage to cause operation of the fuel injector. This kind of fuel injector including a piezoactuator is for example disclosed in JP-A-2003-148221.

Moreover, a spark plug receiving an alternating current with a higher voltage to generate multiple ignition to each cylinder of an engine has been suggested. This kind of spark plug is for example disclosed in JP-A-2002-250265.

In these technologies, a voltage increasing circuit is used, and the voltage increasing circuit increases a battery voltage to a higher voltage (for example, the higher voltage is about 10–30 times of a battery voltage). One example of the voltage increasing circuit is a DC—DC converter.

The DC—DC converter includes an energy storage coil connected to a battery, a switching device for increasing voltage to intermit to the energy storage coil, and a capacitor connected to the energy storage coil. The DC—DC converter charges the capacitor with a higher voltage which occurred in the energy storage coil by intermitting a current by the switching device for increasing voltage.

In general, when an ignition switch (IGSW) turns on, this DC—DC converter is operated to increase output voltage to a target voltage from a battery voltage.

This DC—DC converter enables injectors or spark plugs to supply the higher voltage to complete the charge to the target voltage before a starter switch (starter SW) turns on, even if the starter SW is promptly turned on after turning on the IGSW.

However, according to the prior art, the DC—DC converter conducts a charging operation as shown in dashed line of FIG. 1 when the IGSW is turned on. As a result of the charging operation shown in the dashed line of FIG. 1, a potential problem arises from radio noise (an electromagnetic wave noise) generated by driving the DC—DC converter before the time that the starter SW is turned on (i.e. before the timing of starting an engine). For example, the radio noises may affect sound arrangements or display systems in a vehicle.

Additionally, if a voltage increasing circuit is operated on the timing of turning on the starter switch in order not to generate radio noises before the turning on the starter switch, the voltage increasing circuit requires a time for increasing output voltage of the voltage increasing circuit from battery voltage to a target voltage.

However, in case an operational device (e.g., injector, spark plug) is operated to start the engine before an operation of the voltage increasing circuit is completed, there is a possibility that the operational device is not normally operated by means of shortage of an increasing voltage of the DC—DC converter. Electric-power is thus only used idly since normal operation of the operational device is not performed.

SUMMARY OF NON-LIMITING EXEMPLARY EMBODIMENTS OF THE INVENTION

Exemplary embodiments of present invention resolve the foregoing matter and other problems. Accordingly, one aspect of exemplary embodiments of the present invention is to provide an engine control system capable of suppressing a radio noise before start-up of an engine.

Another aspect of exemplary embodiments of the present invention is to provide an engine control system capable of suppressing useless electrical power consumption (energy loss) by shortage of an increasing voltage of a voltage increasing circuit.

According to one aspect of exemplary embodiments of the present invention, an engine control system includes an ignition switch, and a starter switch which operates a starter of an engine after the ignition switch has been turned on. The engine control system further includes a voltage increasing circuit which increases a battery voltage to a higher voltage supplied to an operational device for running the engine. The engine control system controls the voltage increasing circuit to start to increase a voltage from a battery to the higher voltage upon a timing of turning on the starter switch. Thus, radio noises caused by an operation of the voltage increasing circuit may be avoided from a time at which the ignition switch is turned on to time at which the starter switch is turned on (during a quiet time period).

According to another aspect of exemplary embodiments of the present invention, the engine control system includes a delay unit which delays a beginning of driving of the starter until after a predetermined time from a time the voltage increasing circuit starts to increase the battery voltage. Thus, a driving of the engine by the starter begins after the predetermined time. The operational device for running the engine is thus enabled to begin operation after the completion of increasing the voltage by the voltage increasing circuit. It is therefore possible for the operational device to normally operate without the shortage of a voltage of the voltage increasing circuit.

According to another aspect of exemplary embodiments of the present invention, the engine control system calculates a time for an output voltage of the voltage increasing circuit to reach a target voltage from the battery voltage, based on one or more parameters including coolant temperature of the engine, outside-air temperature, or battery voltage. Thus, the operational device can always begin to operate after the completion of increasing the voltage by the voltage increasing circuit, even if the time charges by means of vehicle parameters.

According to another aspect of exemplary embodiments of the present invention, the engine control system varies the predetermined time according to the calculated time for the output voltage of the voltage increasing circuit to reach the target voltage from the battery voltage. Thus, the operational device can always begin to operate based on the calculated time after the completion of increasing the voltage by the voltage increasing circuit.

According to another aspect of exemplary embodiments of the present invention, the engine control system includes a DC—DC converter as the voltage increasing circuit.

According another aspect of exemplary embodiments of the present invention, the engine control system includes an injector of a fuel injection apparatus for injecting fuel to the engine as the operational device.

According to another aspect of exemplary embodiments of the present invention, the engine control system includes a spark plug of an ignition apparatus for the engine as the operational device.

BRIEF DESCRIPTION OF THE DRAWINGS

The present invention will be understood more fully from the detailed description given hereinafter and from the accompanying drawings of the exemplary embodiments of the invention, which, however, should not be taken to limit the invention to the specific embodiments but are for the purpose of explanation and understanding only.

In the accompanying drawings.

DETAILED DESCRIPTION OF NON-LIMITING EXEMPLARY EMBODIMENTS

An embodiment of the present invention will be described hereinafter with reference to the drawings.

Figure 2:
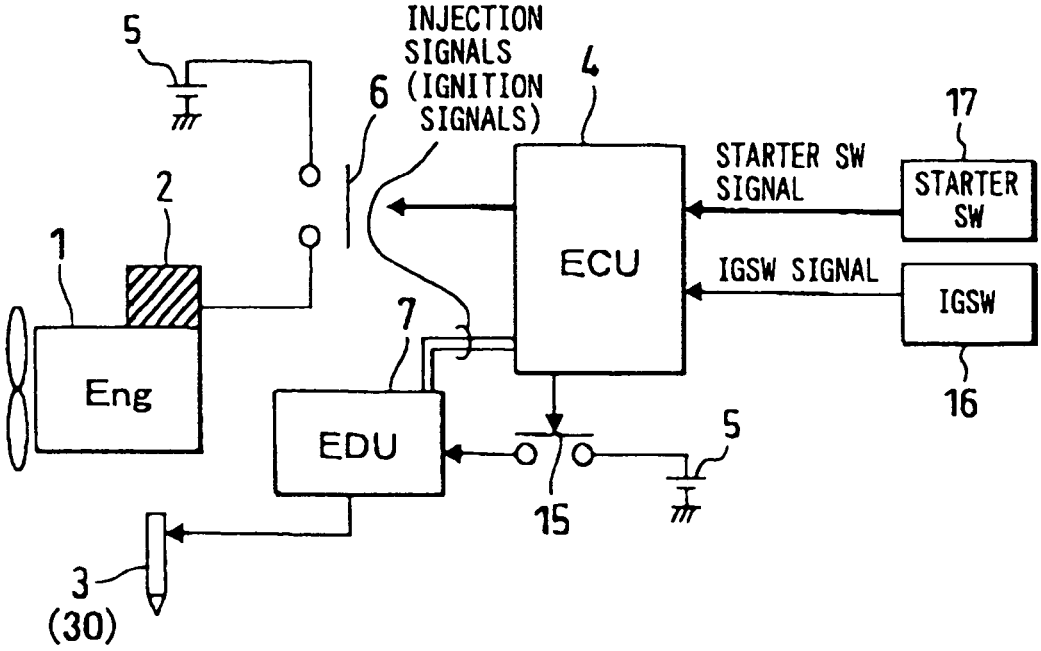
FIG. 2 is a schematic block diagram of the engine control system.
Figure 3:
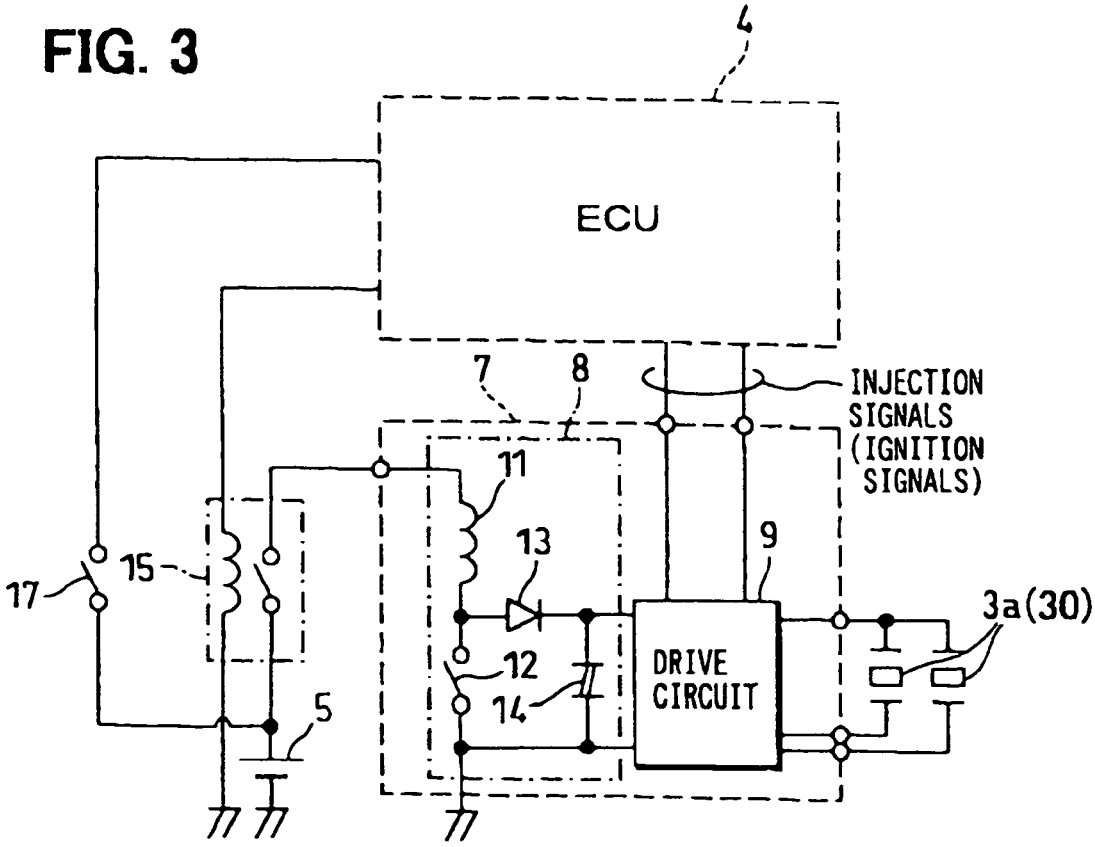
FIG. 3 is a schematic circuit diagram of the engine control system.

As shown in FIG. 2 and FIG. 3, an engine control system includes a starter 2 for starting an internal combustion engine 1, an injector 3 (as an example or an operational device) provided to correspond each cylinder of the engine, an ECU 4 (engine control unit) controlling the operation of the starter 2 and the injector 3.

The starter 2 begins driving when an electric current from a battery 5 equipped with a vehicle is sent, and carries out start-up of the engine 1.

A starter relay 6 is installed in an electric line and is controlled by the ECU 4. When the starter relay 6 is turned on by the ECU 4, the starter 2 is driven.

The injector 3 insects fuel into the cylinder of the engine 1 when it is turned on with electric current. The injector 3 may be formed, for example, by a piezoinjector which injects fuel by receiving a higher voltage in piezoactuator 3*a* as can be appreciated from FIG. 3. It may be formed by an electromagnetic injector which injects fuel by receiving a higher voltage in an electromagnetic actuator (for example, electromagnetic valve).

The injector 3 is supplied a higher voltage from an electric drive unit (EDU) 7. The EDU 7 includes a DC—DC converter 8 forming an exemplary voltage increasing circuit that can increase output voltage (DC—DC voltage) from a battery voltage of the battery 5 toward a predetermined target voltage (for example, 200V), and a drive circuit 9 which gives the injector 3 the higher (increased) voltage of the DC—DC converter 8.

The DC—DC converter 8 comprises an energy storage coil 11 connectable to the battery 5, a switching device 12 (for example, IGBT, power transistor, MOS-FET, contact point type electric switch), and a capacitor 14.

The energy storage coil 11 has a large inductance. The switching deice 12 intermits current to the energy storage coil 11. The capacitor 14 connects the energy storage coil 11 through a diode 13 for back-flow prevention, and stores a higher voltage. The higher voltage stored in the capacitor 14 is supplied to the injector 3 through the drive circuit 9.

An EDU relay 15 controlled by the ECU 4 is installed in an electric line of the energy storage coil 11. The DC—DC converter 8 is able to increase voltage when the ECU 4 turns on the EDU relay 15.

A starter switch (starter SW) 17 and an ignition switch (IGSW) 18 is operated by a driver. When the IGSW 18 is turned on, the ECU 4 receives an IGSW signal and starts up. When the starter SW 17 is turned on, the ECU 4 receives a starter signal.

Figure 4:
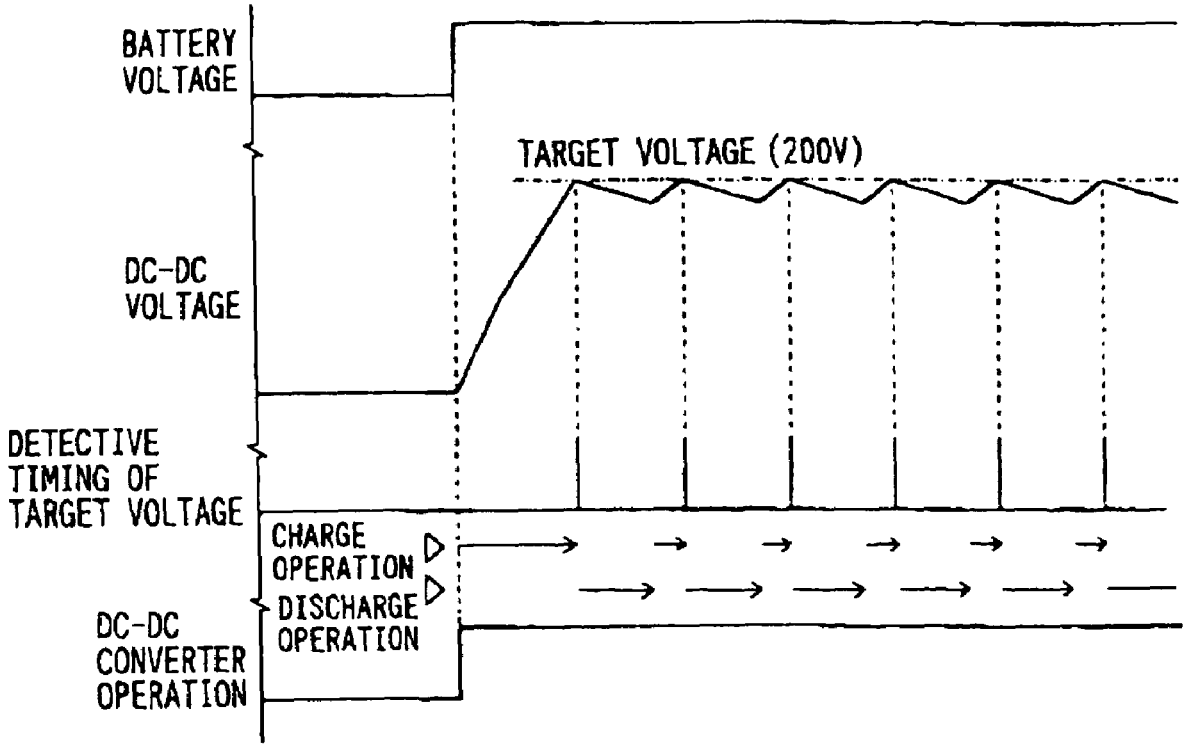
FIG. 4 is a time chart showing an operation of a DC—DC converter of the engine control system.

Here, a basic operation of the DC—DC converter 8 is explained referring to FIG. 4.

When the EDU relay 15 is turned on by means of the ECU 4, the DC—DC converter 8 is supplied with a battery voltage from the battery 5 and begins an operation to increase the battery voltage to a target voltage.

The DC—DC converter 8 monitors a charge voltage charged to capacitor 14 by a monitoring circuit (not illustrated) and carries out (1) and (2) steps below:

(1) The operation for increasing the battery voltage to the target voltage by the DC—DC converter 8 is stopped when the charge voltage of the capacitor 14 (that is, output voltage of the DC—DC converter 8) reaches the target voltage; and (2) The operation for increasing the battery voltage to the target voltage by the DC—DC converter 8 is restarted to increase the battery voltage to the target voltage when the charge voltage of the capacitor 14 falls to a predetermined voltage by natural discharge or discharge for an injecting fuel operation of the injector 3.

Since then, these steps (1) and (2) are repeated until the EDU relay 15 is turned off by means of the ECU 4.

The ECU 4 may be formed by a microcomputer which includes CPU, a memory unit storing various programs and data (e.g., ROM, RAM, stand-by RAM or EEPROM), an input circuit, an output circuit, a power supply circuit, etc. The ECU 4 controls various operations for associated elements such as the starter relay 6 and the EDU relay 15 by performing control processes and numerical computations based on the signals of various sensors for detecting vehicle parameters such as driving conditions of the engine 1, operational conditions by a driver, and/or the vehicle environment.

A voltage control unit for starting the increase of the battery voltage will now be explained. The explanation will include a comparison of the present exemplary embodiments with the operation of an engine control system described in the related art.

Figure 5A:
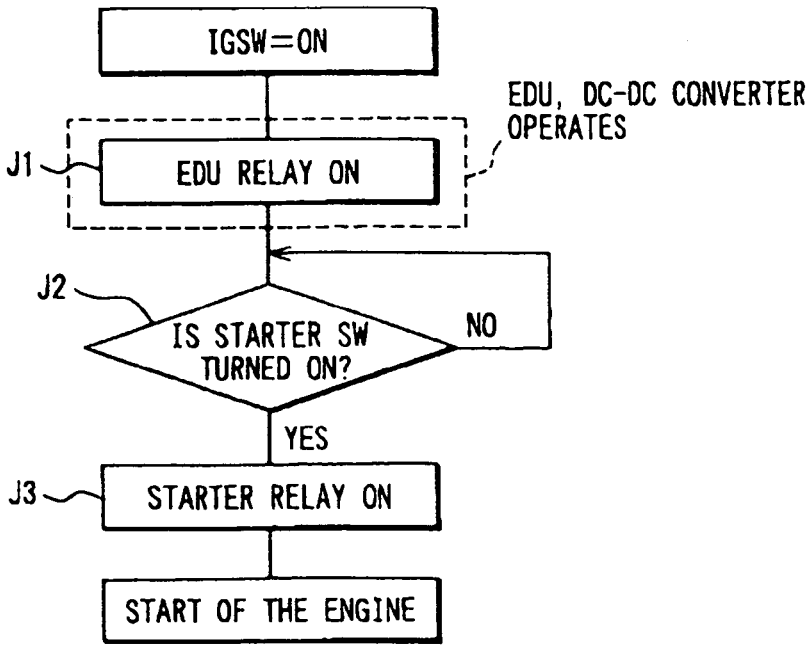
FIG. 5A RELATED ART
FIGS. 5A and 5B are flow charts of the engine control system.

At first, the related art describing operational control of the starter 2 and the DC—DC converter 8 by the ECU 4 is explained with reference to FIG. 5A.

When the IGSW 16 is turned on by a driver, the EDU relay 15 is turned on and the operation of the DC—DC converter 8 begins (Step J1).

It is then determined whether the starter SW 17 has been turned on by a driver (Step J2). If the determination in Step J2 is yes, the starter relay 6 is turned on (Step J3), and start-up of the engine 1 begins.

Figure 1:
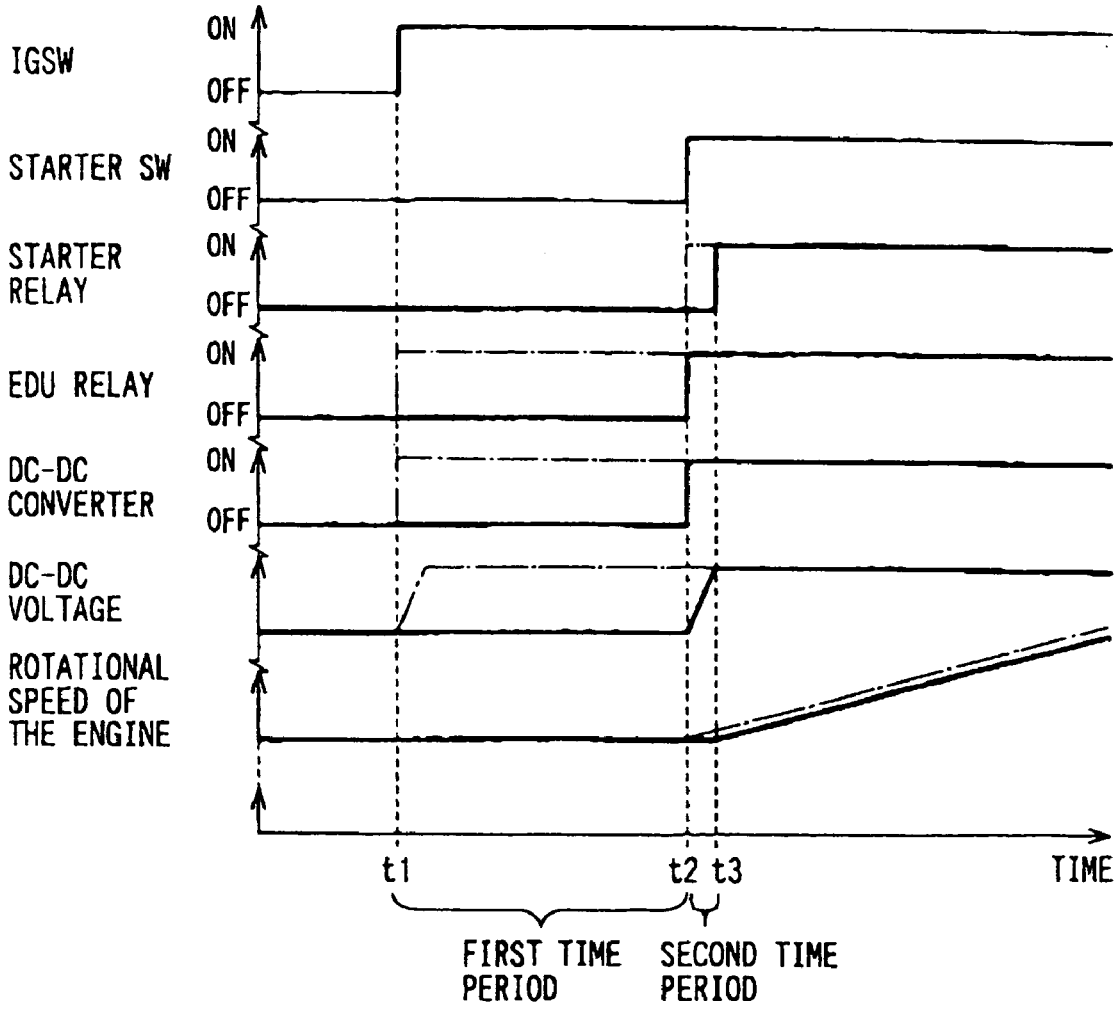
FIG. 1 is a time chart showing an operation of a start-up of an engine of an engine control system according to an exemplary embodiment of the invention.

In this related art, the DC—DC converter 8 conducts a charging operation as shown in dashed line of FIG. 1 when the IGSW 16 is turned on. Accordingly, a potential problem results from generating radio noise (an electromagnetic wave noise) by driving the DC—DC converter 8 before the timing of turning on the starter SW 17 (i.e. before the timing of starting the engine 1).

Features of the voltage control unit for starting the increase of the battery voltage are provided by the ECU 4 of the present exemplary embodiments resolve such a problem.

The voltage control unit for starting voltage increase includes a program which operates to increase the battery voltage to a target voltage by the DC—DC converter 8 after the starter SW 17 is turned on by the driver.

Specifically, the EDU relay 15 continues to remain ON from turning on both the IGSW 16 and the starter SW 17 until the engine stops (that is, the IGSW 16 is turned off). The DC—DC converter 8 does not hereby conduct an operation for increasing a voltage of the DC—DC converter 8 before the starter SW 17 is turned on, even if the IGSW 16 is turned on.

A delay unit for delaying starter operation will now be described.

When the DC—DC converter 8 begins the operation for increasing a voltage at the start of the engine 1, "voltage-increasing time" is necessary to make an output voltage of the DC—DC converter 8 reach a target voltage from the battery voltage.

However, in case the injector 3 is operated by a turning on of the starter SW 17 before the DC—DC converter 8 completes increasing the voltage, there is a possibility that the injector 3 is not normally operated by means of shortage in a voltage of the DC—DC converter 8. Electric-power is thus only used idly since the normal operation of the injector 3 is not performed.

Thus, the delay unit of the ECU 4 of an exemplary embodiment resolves the disadvantage.

The delay unit for delaying starter operation includes a program to make the time at which driving of the starter 2 begins after a predetermined time from the time at which the DC—DC converter 8 begins to increase the voltage (that is, the starter SW 17 is turned on). Specifically, this program turns on the starter relay 6 after the predetermined time from turning on the starter SW 17 has elapsed.

The DC—DC converter 8 thus completes its operation to increase a voltage before the starter SW 17 is turned on.

Figure 5B:
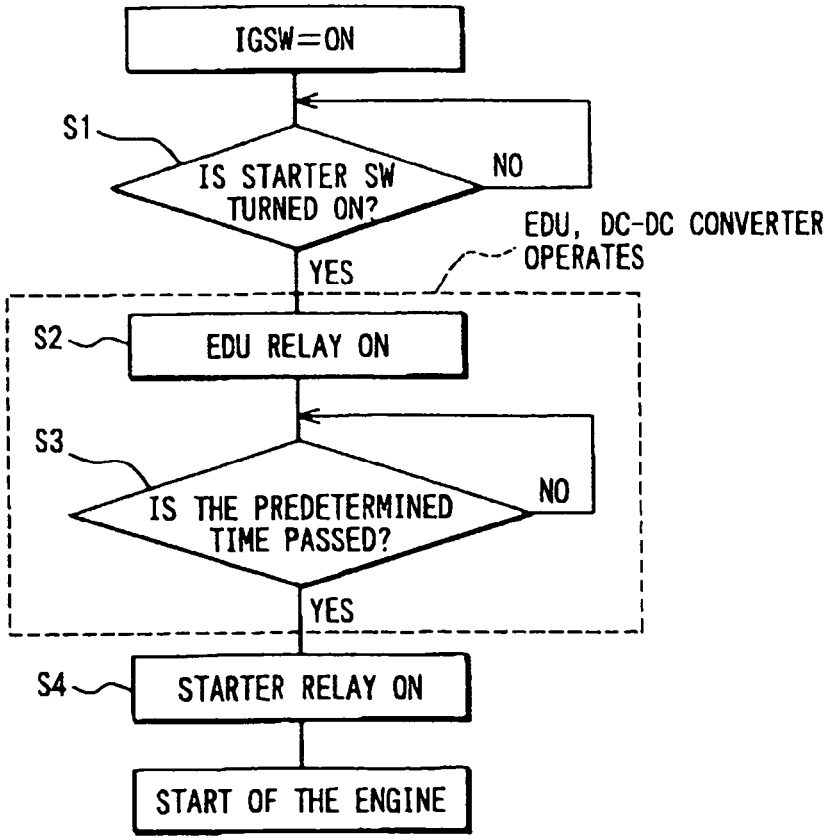

The operational control of the starter 2 and the DC—DC converter 8 by the ECU 4 in accordance with an exemplary embodiment will now be explained referring to the flow chart of FIG. 5B.

When the IGSW 16 is turned on by a driver and the ECU 4 receives a IGSW signal generated by the turning on of the IGSW 16, it is determined whether the starter SW 17 is turned on by receiving a starter SW signal generated by the turning on of the starter SW 17 (Step S1).

If the starter SW 17 is turned on and the ECU 4 receives the starter SW signal, the ECU 4 turns on the EDU relay 15 and an operation of the DC—DC converter 8 begins (Step S2).

Next, in Step S3, it is determined whether the predetermined time passed after turning on the starter SW 17 (after beginning the operation for increasing the voltage of the DC—DC converter 8).

If the determination to Step S3 is yes, the starter relay 6 is turned on (Step S4), and start-up of the engine 1 begins.

Next, the operation in the start-up of the engine 1 is explained referring to a time chart (solid line) of FIG. 1. In addition, to facilitate understanding of the present exemplary embodiment with this time chart, it is to be assumed that time period A from time at which the starter relay 6 is turned on to the time at which the engine 1 actually rotates with the starter 2 and time period B from the time at which the starter relay 6 is turned on to the time at which the injector 3 begins driving are zero.

Even if the IGSW 16 is turned on by means of a driver (timing t1), the EDU relay 15 is still OFF, and the DC—DC converter 8 does not operate and does not generate the higher voltage (DC—DC voltage) when the starter SW 17 is OFF (i.e., before time t2).

Accordingly, during a first time period between time t1 and t2 (see FIG. 1), the DC—DC converter 8 does not operate to increase a battery voltage.

When the starter SW 17 is turned on by the driver (timing t2) the EDU relay 15 is turned on and the DC—DC converter 8 starts operation. As a result, the output of the DC—DC converter 8 increases the battery voltage from the battery 5 to a target voltage during the time period between times t2 and t3 (i.e., during a second time period) in FIG. 1.

On the other hand, if the predetermined time passes after the starter SW 17 is turned on, the starter relay 6 is turned on, and the engine 1 starts rotating with the starter 2 and drives by the operation of the injector 3 (timing t3).

At timing t3, since the output voltage of the DC—DC converter 8 reaches to the target voltage, the injector 3 operates normally and starting of engine 1 is performed normally (after timing t3).

The engine control system of this first exemplary embodiment operates the DC—DC converter 8 after the starter SW 17 is turned on by the delay of the delay unit included in the ECU 4. Therefore, even if the IGSW 16 has been turned on (i.e., at time t1), the DC—DC converter 8 does not operate before the starter SW 17 is turned on (i.e., at time t2).

Thus, radio noises caused by an operation of the DC—DC converter 8 may be avoided from time at which the IGSW 16 is turned on to time at which the starter SW 17 is turned on (i.e., during a quiet time period between times t1 and t2 (the first time period) in FIG. 1).

Thus, the above-described problem (the occurrence of radio noises) due to an operation of the DC—DC converter 8 in the quiet period during the first time period is eliminated.

In addition, the engine control system of this first exemplary embodiment operates the starter 2 after the predetermined time from the beginning of the increase of the voltage from the battery 5 by the DC—DC converter 8 by the delay of the delay unit.

Thus, the injector 3 can begin an operation after the completion of the increase of the voltage by the DC—DC converter 8.

Therefore, when the injector 3 is operated, it can be normally operated without the shortage of a voltage. Moreover, the injector 3 is capable of suppressing an useless electrical power consumption by the shortage of the voltage in the DC—DC converter 8. In other words, the engine control system of first exemplary embodiment is capable of suppressing energy loss caused by the useless operation of the injector 3.

The above-described first exemplary embodiment shows an example in which the predetermined time is uniformly established.

However, the voltage increasing time for increasing the battery voltage to the target voltage may be longer according to the environmental temperature at the time of engine starting (cryogenic temperature etc.), the variations per hour (life etc.) of the battery 5, the target voltage (higher magnification voltage increasing etc.), and a capability of increasing voltage of the DC—DC converter 8 etc.

Therefore, in accordance with a second exemplary embodiment, a time calculating unit for computing the voltage increasing time for the delay circuit for delaying the starter operation based on vehicle parameters (the coolant temperature of the engine 1, outside-air temperature, battery voltage, etc.) operates to set up the predetermined time so that the voltage increasing time which the calculating unit computes is longer.

Thus, even when the time for increasing a voltage becomes long such as, for example, at the time of cold-starting of an engine in a cold climate area, the injector 3 can be always operated after increase of a voltage by the DC—DC converter 8 has completed.

As a result, even if the voltage increasing time changes in accordance with vehicles parameters, the energy loss caused by useless operation of the injector 3 can be reduced.

The first and second exemplary embodiments describe the example which drives the injector 3 by higher voltage of the DC—DC converter 8. On the other hand, a spark plug 30 of an ignition apparatus for generating a higher voltage may be used as an operational device for running an engine rather than an injector in a third exemplary embodiment.

The DC—DC converter 8 of this third exemplary embodiment is formed so that the increased voltage may be supplied to a primary coil of a ignition coil. This ignition apparatus makes a secondary coil generate alternating current of a further high voltage because it is intermittent by a switching device in the primary coil of the ignition coil with which the higher voltage is impressed from the DC—DC converter 8. This ignition apparatus makes the spark plug 30 linked to the secondary coil generate multiplex ignition.

Operation control of the DC—DC converter 8 gives the higher voltage to the ignition apparatus in the same manner as described above in the first and second embodiment. Thus, the DC—DC converter 8 does not enable operation of the spark plug 30 drive until the starter SW 17 is turned on even if the RGSW 16 has been turned on. Therefore, above-described problem of a radio noise etc. by operation of the DC—DC converter 8 may be avoided, after the IGSW 16 turns on and before the starter SW 17 is turned on (i.e., during the quiet time period between times t1 and t2 (the first time period) in FIG. 1). Moreover, the spark plug 30 can be operated after the increase of a voltage has been completed. Thus, the energy loss caused by useless operation of the ignition apparatus can be reduced.

Modification and other exemplary embodiments will be now described.

If the voltage increasing time is short because the voltage increasing performance of the DC—DC converter 8 is higher, it may start operation of the DC—DC converter 8 and the starter 2 simultaneously.

The present invention should not be limited to the disclosed exemplary embodiments, but may be implemented in other ways without departing from the spirit of the invention.

What is claimed is:

1. An engine control system comprising:

an ignition switch;

a starter switch for operating a starter of an engine after the ignition switch has been turned on;

a voltage increasing circuit for increasing a battery voltage to a higher voltage;

an operational device for running the engine, the operational device receiving the higher voltage from the voltage increasing circuit;

a voltage control circuit for controlling the voltage increasing circuit to start increasing the battery voltage upon a timing of turning on the starter switch; and a delay circuit for delaying a beginning of driving the starter until after a predetermined time from a time the voltage increasing circuit starts to increase the battery voltage.

2. The engine control system according to claim 1, wherein the voltage increasing circuit is a DC—DC converter which comprises an energy storage coil connected to a battery which provides the battery voltage, a switching circuit for increasing the battery voltage to intermit current to the energy storage coil, and a capacitor connected to the energy storage coil which stores a charge at the higher voltage.

3. The engine control system according to claim 1, wherein the operational device is an injector of a fuel injection apparatus for injecting fuel to the engine.

4. The engine control system according to claim 1, wherein the operational device is a spark plug of an ignition apparatus for the engine.

5. An engine control system comprising:

an ignition switch;

a starter switch for operating a starter of an engine after the ignition switch has been turned on;

a voltage increasing circuit for increasing a battery voltage to a higher voltage;

an operational device for running the engine, the operational device receiving the higher voltage from the voltage increasing circuit;

a voltage control circuit for controlling the voltage increasing circuit to start increasing the battery voltage upon a timing of turning on the starter switch; and a delay circuit for delaying a beginning of driving the starter until after a predetermined time from a time the voltage increasing circuit starts to increase the battery voltage;

wherein the delay circuit includes a calculating circuit for calculating a time for an output voltage of the voltage increasing circuit to reach a target voltage from the battery voltage, based on one or more parameters including coolant temperature of the engine, outside-air temperature, or battery voltage.

6. The engine control system according to claim 5, wherein the calculating circuit varies the predetermined time according to the calculated time for the output voltage of the voltage increasing circuit to reach the target voltage from the battery voltage.

7. A method of controlling an engine, the method comprising:

receiving an ignition switch signal generated by a turning on the ignition switch at the beginning of a first time delay period;

receiving a starter switch signal generated by a turning on of a starter switch, to operate a starter of an engine after the first time delay period which begins at the receiving the ignition switch signal;

starting to increase a battery voltage upon the turning on of the starter switch at the beginning of a second time delay period;

increasing the battery voltage to a higher voltage during the second time delay period; and supplying the higher voltage to an operational device of the engine at the end of the second time delay period.

8. The method as in claim 7, wherein the operational device is an injector of a fuel injection apparatus for injecting fuel to the engine.

9. The method as in claim 7, wherein the operational device is a spark plug of an ignition apparatus for the engine.

10. A method of controlling an engine, the method comprising:

receiving an ignition switch signal generated by a turning on the ignition switch at the beginning of a first time delay period;

receiving a starter switch signal generated by a turning on of a starter switch, to operate a starter of an engine after the first time delay period which begins at the receiving the ignition switch signal;

starting to increase a battery voltage upon the turning on of the starter switch at the beginning of a second time delay period;

increasing the battery voltage to a higher voltage during the second time delay period; and supplying the higher voltage to an operational device of the engine at the end of the second time delay period;

wherein the second time delay period is a predetermined time period which is calculated based on a time that the battery voltage starts to increase until a time that the higher voltage reaches a target voltage level based on one or more parameters including coolant temperature of the engine, outside-air temperature, and battery voltage.

11. The method as in claim 10, wherein the predetermined time period is variable.

* * * * *